US005988438A

United States Patent [19]

Lewis et al.

[11] Patent Number: 5,988,438

[45] Date of Patent: Nov. 23, 1999

[54] APPARATUS FOR RAPID INFLATION OF INFLATABLE OBJECT AND RELATED METHOD

[75] Inventors: Donald J. Lewis, Scottsdale; Donald E. Olander, Tempe; Michael C. Magenot, Phoenix, all of Ariz.

[73] Assignee: Universal Propulsion Company, Inc., Phoenix, Ariz.

[21] Appl. No.: 09/039,261

[22] Filed: Mar. 16, 1998

[51] Int. Cl.[6] ..... B67D 5/00; B63C 9/125; B63B 35/58

[52] U.S. Cl. ..... 222/3; 441/41; 441/92; 441/98; 441/99; 441/101

[58] Field of Search ..... 441/41, 92, 98, 441/99, 100, 101; 222/3

[56] References Cited

U.S. PATENT DOCUMENTS

| | | | |
|---|---|---|---|
| 3,833,029 | 9/1974 | Munn | 441/100 |
| 4,062,288 | 12/1977 | Millray | 222/3 |
| 4,097,241 | 6/1978 | Garner et al. | 441/98 |
| 4,355,987 | 10/1982 | Miller | 441/41 |
| 4,368,009 | 1/1983 | Heimovics, Jr. et al. | 417/191 |
| 5,494,312 | 2/1996 | Rink | 222/3 |
| 5,586,615 | 12/1996 | Hammer et al. | 182/48 |
| 5,601,310 | 2/1997 | Di Giacomo et al. | 222/3 |
| 5,907,120 | 5/1999 | Mooney et al. | 102/521 |

*Primary Examiner*—Kevin Shaver
*Assistant Examiner*—Keats Quinalty
*Attorney, Agent, or Firm*—Pennie & Edmonds LLP

[57] ABSTRACT

The present invention relates to an inflator device that is adapted for producing a sufficient quantity of a gaseous product to substantially inflate an inflatable member. The inflator device has a first stage gas source in fluid communication with a second stage gas source, which, in turn, is in fluid communication with the inflatable member. The second stage gas source contains a liquified gas in an amount sufficient to inflate the inflatable member upon vaporization of the liquified gas, and the first stage gas source is capable of providing a sufficient quantity of gas at a sufficiently high temperature to the second stage gas source to vaporize substantially all of the liquified gas in the second stage gas source.

36 Claims, 3 Drawing Sheets

APPARATUS FOR RAPID INFLATION OF INFLATABLE OBJECT AND RELATED METHOD

FIELD OF THE INVENTION

The present invention is directed to a gas generator that is capable of producing large quantities of low temperature gas. In particular, the invention relates to a gas generator or inflator for inflating an inflatable member, such as the emergency exit ramps or slides, life rafts, etc. carried on commercial aircraft.

BACKGROUND OF THE INVENTION

Initially, gas generators used to inflate large emergency exit ramps or slides on commercial aircraft used a pyrotechnic gas generant that produced a large volume of hot gas on combustion. However, it was soon discovered that the temperature of the hot gas was sufficiently high to burn the fabric used to construct the exit ramp or slide, as well as anyone using the ramp or slide. In addition, because the temperature of the inflation gas was well above the ambient temperature, the ramp or slide would partially deflate as the gas cooled and the pressure of the gas decreased as a result of the temperature change. This was particularly true if the airplane was required to put down in cold water, such as that found in northern oceans.

In an attempt to overcome the deficiencies of pyrotechnic inflators, as described above, such rafts and ramps or slides were inflated using a compressed gas, as disclosed in U.S. Pat. No. 4,355,987 to Miller and U.S. Pat. No. 5,586,615 to Hammer et al. However, where only a compressed gas is utilized to inflate the raft or ramp or slide, a large drop in temperature occurs in the gas as it expands, often causing ice to form, which can block the flow of gas. To overcome these problems, emergency exit ramps or slides and rafts presently carried on commercial aircraft typically employ an inflation system comprising a compressed gas source and an aspirator, such as that disclosed in U.S. Pat. No. 4,368,009 to Heimovics et al. As the compressed gas is released, the vacuum produced thereby causes the aspirator to ingest about four times as much gas as is supplied by the compressed gas source.

However, even these aspirator systems have several disadvantages. They are large and heavy, and produce gas at a relatively slow rate. Moreover, the rate is further slowed as the back pressure of the gas in the object being inflated increases. This can cause difficulties, e.g., in the deployment of an emergency ramp or slide from an aircraft that has landed in water. Because of the slow rate of inflation, a ramp or slide may float under the aircraft before becoming fully inflated, and become trapped. Even where the ramp or slide does not become trapped, the slow rate of inflation may force occupants of the aircraft to wait for the ramp or slide to fully inflate, which can result in panic on the part of the passengers. Therefore, it is desirable to minimize the amount of time required to inflate the ramp or slide.

The weight of an aspiration inflator system is high even when the high pressure container required to store the pressurized gas is made from lightweight materials, such as titanium with a wound graphite filament overwrap. This reduces the carrying capacity of the aircraft. These systems also present a maintenance problem to ensure that the required gas pressure is maintained, and that the aspirator will function properly. Moreover, even using a high pressure gas source, an aspiration system can only provide a maximum pressure of about 2 psig, i.e., about 2 psi above normal atmospheric pressure. Therefore, to support occupants from the aircraft, an inflatable member inflated with an aspirator system must be much larger than would be required if the member was inflated to a higher pressure.

Therefore, there remains a need for a rapid, relatively low weight inflator that is able to inflate an aircraft emergency exit ramp or slide, life raft, or other relatively large inflatable objects rapidly and to a relatively high pressure. The present invention provides such an inflator.

SUMMARY OF THE INVENTION

The present invention relates to an inflator device that is adapted for producing a sufficient quantity of a gaseous product to substantially inflate an inflatable member. The inflator device comprises a first stage gas source in fluid communication with a second stage gas source, which, in turn, is in fluid communication with the inflatable member. The second stage gas source contains a liquified gas in an amount sufficient to inflate the inflatable member upon vaporization of the liquified gas, and the first stage gas source is capable of providing a sufficient quantity of gas at a sufficiently high temperature to the second stage gas source to vaporize substantially all of the liquified gas in the second stage gas source.

The first stage gas source may comprise means for generating gas from the combustion of a pyrotechnic material, from the release of a quantity of compressed gas or a combination thereof. Useful compressed gases include, but are not limited to, chemically inert gases, such as nitrogen, helium, and argon.

Preferably, the first stage gas source further comprises a first stage housing with an inner surface, defining a first interior volume, and containing a pressurized gas at a first pressure within the first interior volume. The preferred first stage gas source also comprises a first stage seal adapted to maintain the pressurized gas at the first pressure within the first interior volume, and to open when the gas attains a predetermined second, higher pressure, and a pyrotechnic material within the interior volume of the first stage housing, which acts as a heat source upon combustion to increase the pressure of the pressurized gas to the second, higher pressure, opening the first stage seal to allow the gas to pass from the first stage housing to the second stage gas source. Combustion of the pyrotechnic material is typically initiated by an ignitor in thermal contact with the pyrotechnic material.

The first pressure of the compressed gas is preferably sufficiently high and the pyrotechnic material has a burning time which is sufficiently short, such that, upon combustion, the pyrotechnic material burns substantially completely and without substantial contact of burning material upon the inner surface. As a result, at least a portion of the pressurized gas at the first pressure is heated, thereby increasing the gas pressure to at least the second pressure to cause the seal to open and the gas to exit the first interior volume in a time sufficiently short to substantially prevent transfer of heat to the first stage housing.

The preferred second stage gas source typically comprises a second stage housing defining a second interior volume, an inlet, an outlet, and gas directing means for directing a quantity of gas from the first stage gas source to a predetermined location within the second stage gas source. The inlet is in fluid communication with the first stage gas source and the gas directing means to allow gas to pass from the first stage gas source to the predetermined location within the second stage gas source. The introduction of gas into the second stage gas source vaporizes the liquified gas to a pressure sufficiently high to open a seal in the outlet of the second stage, allowing the vaporized liquified gas to pass from the second stage gas source into the inflatable member, inflating the member.

Preferably, the gas directing means is a metering tube extending within the interior volume of the second stage housing to provide gas from the first stage gas source into the second interior volume. The metering tube may be adapted to release the gas from the first stage gas source at various of positions within the interior volume of the second stage housing, e.g., proximate to the inlet of the second stage, proximate to the outlet of the second stage, or at an intermediate position, depending on the temperature profile desired for the output from the second stage gas source.

The liquified gas in the second stage gas source may be any gas that liquifies when pressurized, but which vaporizes when mixed with a relatively hot gas. Useful liquified gases include, but are not limited to freons, halons, nitrogen, and carbon dioxide. Preferably, the liquified gas is a mixture of carbon dioxide and up to about 25 mole percent nitrogen. By the appropriate choice of liquified gas and the proper positioning of the gas directing means the second stage gas source may be adapted to provide a gas having a temperature of from about −10° to 100° C., preferably about 0° C.

The invention also relates to a method for rapidly inflating an inflatable object with the inflator of the invention. The method comprises releasing gas from a first stage gas source to provide a sufficient quantity of gas at a sufficiently high temperature to vaporize substantially all of a liquified gas in a second stage gas source in fluid communication with the first stage gas source, introducing the gas released from the first stage gas source into the second stage gas source, which is in fluid communication with an inflatable member, and contains liquified gas in an amount sufficient to inflate the inflatable member upon vaporization of the liquified gas, and distributing the vaporized gas from the second stage gas source within the inflatable member to inflate the inflatable member.

Preferably, a pyrotechnic material located within the first stage gas source housing is burned to generate heat, thereby increasing the pressure of a pressurized gas within the first stage gas source to a pressure sufficiently high to open the first stage seal to allow the gas to pass from the first stage to the second stage. Most preferably, the first pressure is sufficiently high and the pyrotechnic material has a burning time which is sufficiently short such that, upon combustion, the pyrotechnic material burns substantially completely and without substantial contact of burning material upon the inner surface of the housing. As a result, when the pyrotechnic material is burned, the heat from the burning material is substantially entirely thermally transferred to the pressurized gas, so that the pressurized gas at the first pressure is heated, thereby increasing the gas pressure to at least the second pressure to cause the first stage seal to open, allowing the gas to exit the interior volume in a time sufficiently short to substantially prevent transfer of heat to the housing means.

The introduction of the gas from the first stage gas source into the interior volume of the second stage gas source vaporizes the liquified gas in the second stage gas source, increasing the pressure within the second stage and opening a second stage seal, and allowing the vaporized liquified gas from the second stage gas source to be released from the second stage gas source into the inflatable member to inflate the inflatable member.

DETAILED DESCRIPTION OF THE INVENTION

As used herein, the term "temperature profile" refers to the change in temperature with time of the output gas of the inflator of the invention.

The present invention is directed to an inflator and a method of rapidly producing large volumes of gas having a controlled temperature with the inflator. The inflator comprises a first stage gas source that produces a gas having a temperature sufficiently high to vaporize a liquified gas and a second stage main gas source containing liquified gas. The first and second stage gas sources are in fluid communication, such that, gas produced or stored in the first stage is introduced into the liquified gas in the second stage gas source, thereby vaporizing the liquified gas, and increasing the pressure within the second stage gas source. The increased pressure within the second stage gas source causes a seal in the second stage gas source to open, allowing the vaporized gas to exit from the second stage gas source. The gas thus produced is used, e.g., for inflating an inflatable member, such as a raft, chute, or ramp or slide.

The temperature of the output gas from the second stage source is controlled by the location within the second stage gas source at which the output from the first stage gas source is introduced. Thus, depending upon the location at which the gas is introduced in the second stage gas source the inflator of the invention may produce (1) an output gas having a substantially constant temperature throughout the time period during which the inflator functions, i.e., during the output of the gas, (2) an output gas having an initially high temperature that decreases during the output of the gas, or (3) an output gas having an initially low temperature that increases during the output of the gas.

Figure 1:
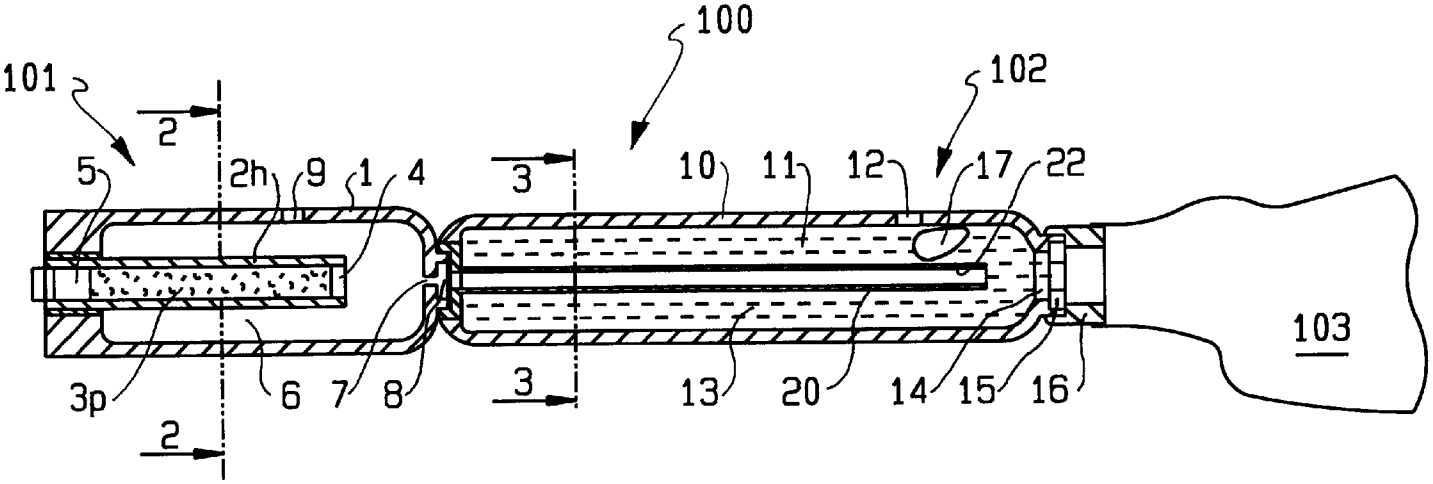
FIG. 1 is an elevational sectional view of the apparatus of the present invention including first and second gas generating components.

An inflator in accordance with the present invention is shown in FIG. 1. Inflator 100 comprises a first stage gas source 101 for producing relatively hot gas and a second stage gas source 102 for producing a relatively cool gas. A variety of gas generators known in the art are capable of producing a sufficient quantity of gas at a sufficiently high temperature to vaporize the liquified gas in the second stage gas source 102, and they may be incorporated in first stage gas source 101. These include pyrotechnic gas generators, compressed gas sources, and hybrid detectors, which comprise a combination of a pyrotechnic material and a compressed gas source.

Pure pyrotechnic gas generators for use in the present invention are also commonly used as inflators in automotive air bag passive restraint systems, which are well known in the art. Pyrotechnic gas generators typically comprise a housing containing a pyrotechnic material capable of generating a volume of hot gas upon the combustion of the pyrotechnic material, an initiator or ignitor to initiate combustion of the pyrotechnic material, and, typically, a seal that opens at a predetermined pressure to release the generated hot gas, such as a rupturable diaphragm or pop-off valve. Upon receiving an appropriate signal, the initiator causes the pyrotechnic material to burn, generating hot gas, and increasing the pressure within the housing. The seal opens, releasing the hot gas when the pressure within the housing achieves the predetermined pressure.

Typical pure compressed gas sources, such as may be used with first stage gas source 101, contain a quantity of compressed gas that upon release from the source expands to produce a desired volume of gas. As the rapid increase in pressure that opens the seal with a pyrotechnic gas source does not occur with a pure compressed gas source during normal operation, a rupturable diaphragm, i.e., a diaphragm made from metal, plastic, or other appropriate material that breaks open when the pressure differential across the diaphragm exceeds a predetermined amount, or a pop-off valve, i.e., a valve that opens automatically when the difference in pressure across the valve exceeds a predetermined amount, is not appropriate for releasing the gas from the compressed gas source. Instead, other means for releasing the compressed gas, such as a rapidly opening valve, a seal held with an explosive bolt, or other similar mechanical, chemical, or electronic device, is required to release the gas from first stage gas source 101.

The preferred first stage gas source 101, however, is a hybrid inflator as disclosed in copending, co-assigned application Ser. No. 08/587,773, filed Dec. 22, 1995, for an "INFLATABLE PASSENGER RESTRAINT AND INFLATOR THEREFORE", the contents of which are incorporated herein in their entirety by reference. A preferred hybrid inflator comprises a housing 1 defining a first interior volume 6, which volume 6 contains a highly pressurized chemically inert gas, such as nitrogen or argon, a pyrotechnic material 3*p*, and an initiator 5, e.g., a pyrotechnic squib, to initiate the combustion of the pyrotechnic material 3*p*. Other useful initiators for initiating the pyrotechnic materials useful in the invention are well known in the art. The preferred pyrotechnic material comprises ammonium nitrate as an oxidizer, an energizer, e.g., RDX, HMX, CL-20, TEX, NQ, NTO, TAGN, PETN, TATB, TNAZ, or mixtures thereof, and a solvent processable binder. The pressurized gas may be introduced into the housing through a fill port 9. A first stage seal 8 situated within a first stage outlet aperture 7 maintains the pressure of the pressurized gas within the interior volume 6, but opens when the gas attains a predetermined higher pressure upon combustion of a pyrotechnic material 3*p*. The first stage seal 8 may be a rupturable diaphragm, a pop-off valve.

The pyrotechnic material 3*p* may be any pyrotechnic material known in the art that has a rapid burn rate, i.e., typically, less than about 10 milliseconds, and may be shaped into any form that allows for the rapid combustion of the material, e.g., powder, flakes, pellets, or stick. The preferred pyrotechnic material has a burning time that is sufficiently short, and the pressure of the gas in the first stage gas source is sufficiently high, i.e., typically, greater than about 10,000 psi, that, upon combustion, the pyrotechnic material burns substantially completely without substantial contact of burning material with the inner surface of the first stage gas source housing 1, so that little or no thermal energy is transferred from the burning material to the housing 1. The pyrotechnic material 3*p* may be located within a holder 2*h* having an end plug 4, as shown in FIG. 1. Either or both of holder 2*h* or end plug 4 may be solid, frangible or porous, as long as the holder 2*h* and end plug 4 allow the hot gases formed from the combustion of pyrotechnic material 3*p* to readily escape from the holder 2*h* to heat the pressurized gas in volume 6, thereby increasing the pressure of the gas. However, the pyrotechnic material in the preferred first stage gas source need not be stored in a container, as shown in FIG. 1, but, instead, may be formed into a stick, applied in a thin coating over a layer of insulating material on a surface within the first stage housing 1, or in any other configuration, as would be well known in the art, that is adapted to provide the required burning rate.

As discussed above, the combustion of the pyrotechnic material 3*p* adds heat energy to the pressurized inert gas, increasing the pressure within the first stage housing 1. The first stage seal 8 opens when the pressure of the inert gas attains a predetermined higher pressure, allowing the gas from the first stage gas source 101 to expand and pass through the first stage outlet aperture 7 into the second stage gas source 102 of the inflator 100. This process preferably occurs in a time sufficiently short to prevent any substantial transfer of heat to the first stage housing 1.

Figure 2:
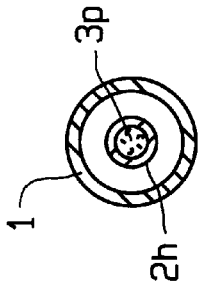
FIG. 2 is a sectional view through the first stage gas source, taken along line 2—2 of FIG. 1.
Figure 3:
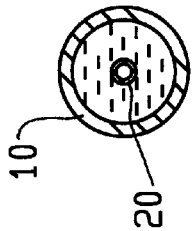
FIG. 3 is a sectional view through the second stage gas source, taken along line 3—3 of FIG. 1.

The second stage gas source 102 comprises a second housing 10, having a second interior volume 13 with an inner surface, and contains a stored liquified gas 11 with, typically, a small ullage volume 17 of non-liquified gas. Although the second stage housing 10, as well as the first stage housing 1, may be cylindrical, as shown in FIGS. 1, 2, and 3, these housings may be constructed in any shape that meets the space requirements for a given application, and allows for the rapid generation of gas.

The liquified gas 11 may be any gas known in the art that may be stored in a liquid state when pressurized, and which rapidly vaporizes when heated or when the pressure on the gas is reduced. Gases that may be liquified for use in the invention, either alone or in combination, include, but are not limited to, carbon dioxide, nitrogen, and freons and halons, i.e., chlorofluorocarbons and bromofluorocarbons, which are now available commercially in forms that, unlike Freon 11, $CFCL_3$, and Freon 12, $CF_2Cl_2$ contain at least one hydrogen atom, and, thus, are chemically removed in the lower atmosphere, preventing the introduction of the chlorine and bromine atoms in the molecules into the stratosphere, and the resulting removal of ozone from the ozone layer. Preferably, the liquified gas is carbon dioxide or a mixture of carbon dioxide with up to about 25 percent nitrogen.

The second stage housing 10, further comprises a gas fill port and plug 12, which may be used to monitor the pressure of the stored liquified gas 11, and a second stage outlet aperture 14 closed with a second stage seal 15. The second stage seal 15 maintains the liquified gas 11 within the interior volume 13 of second stage housing 10 at a first, storage pressure, but opens when the liquified gas is vaporized by the introduction of relatively hot gas from the first stage gas source 101, and the pressure within the second stage gas source 102 increases to a predetermined higher pressure. As with the first stage seal 8, the second stage seal 15 may be a rupturable diaphragm, a pop-off valve, or any other type of openable seal known in the art.

Typically, the housing 10 also comprises an adaptor 16 for interconnecting the inflator 100 with an inflatable member 103, such that when second stage seal 15 opens, vaporized gas flows from the interior volume 13 of second stage housing 10, through the second stage outlet aperture 14 and adaptor 16 into inflatable member 103, such that inflatable member 103 is rapidly inflated.

The second stage gas source 102 also comprises means for directing a quantity of gas from the first stage gas source to a predetermined location within the second stage gas source. Preferably, the means for directing a quantity of gas from the first stage gas source to a predetermined location within the second stage gas source is a metering tube 20. The diameter of metering tube 20 is typically approximately equal to that of the first stage orifice 7, but may be adjusted to control the velocity of the gases in metering tube 20, depending on the application. The metering tube 20 introduces the quantity of relatively hot gas from the first stage gas source 101 into the liquified gas 11 within the interior volume 13 of the second stage housing 10. Where the second stage housing 10 is cylindrical, the metering tube 20 is typically concentric with the housing 10 as shown in FIGS. 1 and 3, but may be adapted to introduce the output gas from the first stage gas source 101 at any point within the liquified gas 11 that will provide a desired output gas temperature profile. Metering tube 20 may be either open or closed at tube end 22, and can be varied in length to extend to substantially any part in the interior of volume 13. Where tube end 22 is closed, the metering tube 22 must be otherwise adapted to allow gas from the first stage gas source 101 to enter the interior volume 13 of second stage housing 10 to vaporize the liquified gas 11. This may be accomplished by using a porous material to form the metering tube 20, or by placing one or more appropriately sized holes in the walls of the metering tube 20. The placement of the holes or the length of the tube 20, where the tube end 22 is open, may be used to control the temperature of the gas exiting the inflator.

Figure 4:
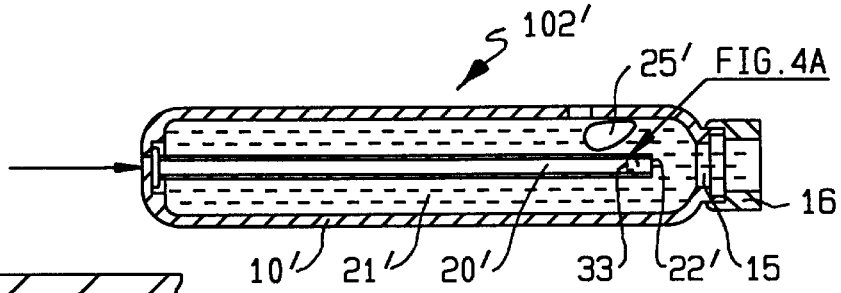
FIG. 4 illustrates an alternate embodiment of a second gas source according to the invention, having a perforated tube end plug in the terminal end of the tube extending into the second stage.
Figure 4A:
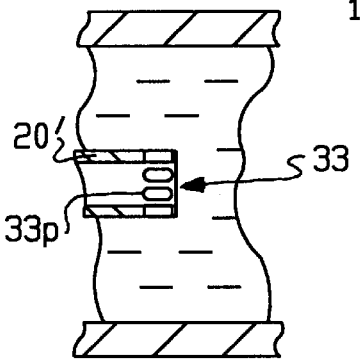
FIG. 4A is an enlarged sectional view of a portion of FIG. 4 with the aperture of the gas directing means located at a first position (Position A) of said means.

For example, when the tube end 22 is open as shown in FIG. 1 or where tube end 22 is closed, and the metering tube 20 defines one or more openings 34 either near its end 22 or in a perforated plug 33, as shown in FIGS. 4 and 4A, the initial output from the second stage gas source 102 is relatively hot, followed by progressively colder gas as the liquified gas 11 vaporizes and exits through the second stage outlet aperture 14. This corresponds to temperature profile A in FIG. 7.

Figure 5:
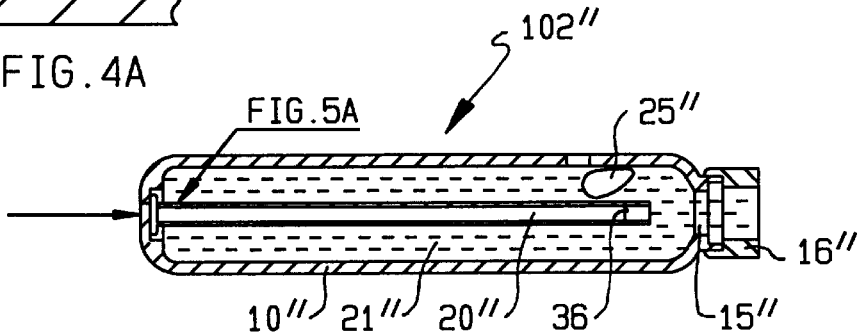
FIG. 5 is a view similar to FIG. 4 illustrating an embodiment with tube perforations in the end portion of the tube opposite the terminal end of the tube extending into the second stage.
Figure 5A:
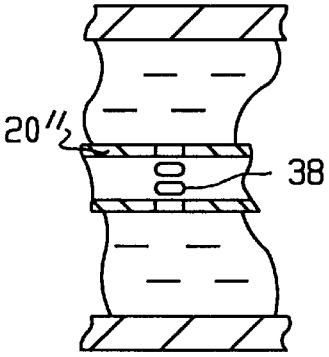
FIG. 5A is an enlarged sectional view of a portion of FIG. 5 with the aperture of the gas directing means located at a second position (Position B) of said means.
Figure 7:
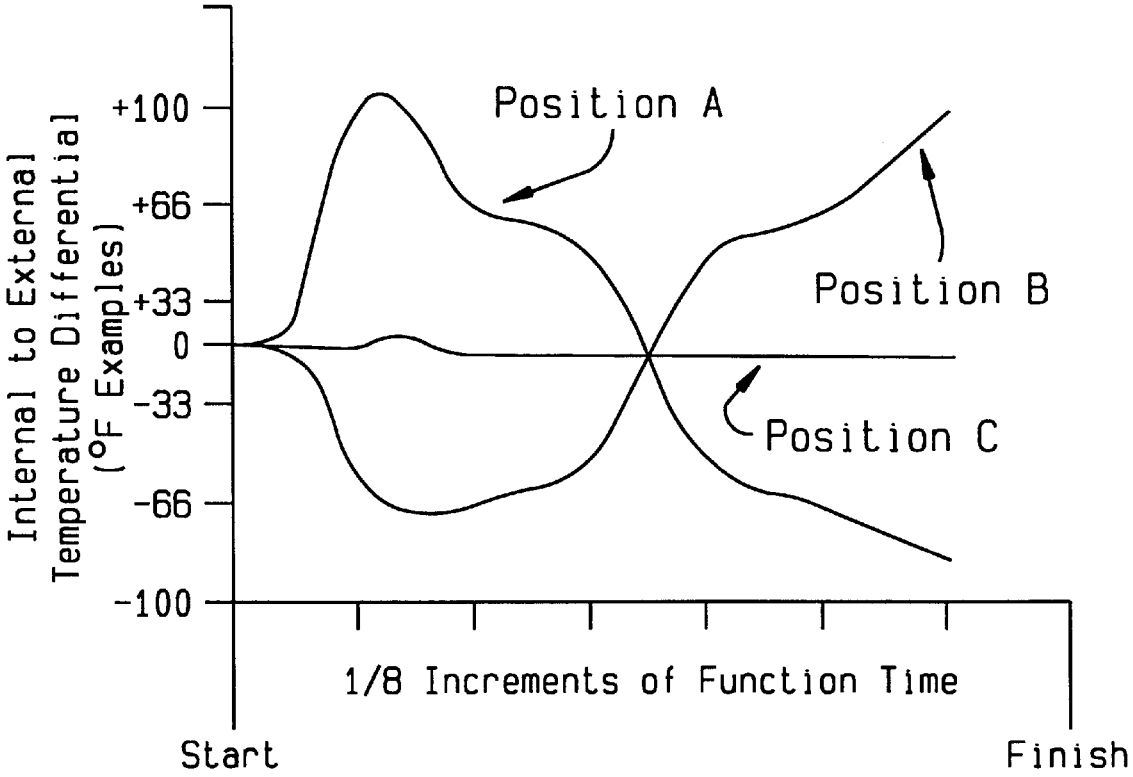
FIG. 7 is a graph in which the difference in the temperature between the interior of an inflatable member and that of the surrounding environment is plotted against the inflation time. for a gas directing means provided with aperture at a variety of different positions.

Alternatively, to obtain an output gas temperature profile that becomes progressively warmer as vaporized gas exits the inflator, as shown in temperature profile B in FIG. 7, the output from the first stage gas source should be introduced into the liquified gas at a location opposite the second stage outlet aperture 14. This may be accomplished by using a short, open metering tube 20, or by closing end 22 of the metering tube 20, typically, with a blank or solid plug 36, and providing holes 38 in the metering tube 20 at the end opposite end 22, as shown in FIGS. 5 and 5A.

Figure 6A:
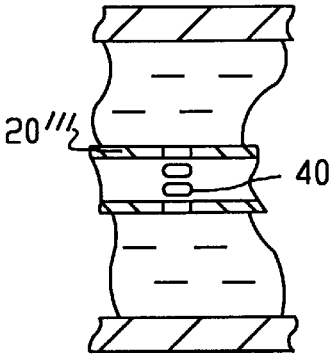
FIG. 6A is an enlarged sectional view of a portion of FIG. 6 with the aperture of the gas directing means located at a third position (Position C) of said means.
Figure 6:
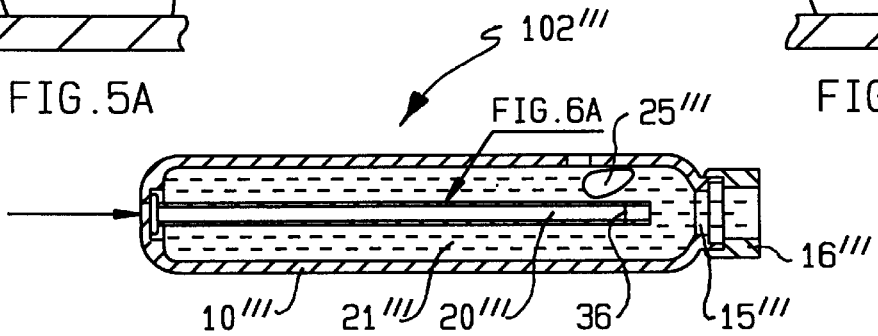
FIG. 6 illustrates a further alternate embodiment of the second stage gas source.

It is also possible to obtain an output gas having a substantially constant temperature after a short period of operation, as shown in temperature profile C, by locating the output of the metering tube 20 near the center of second stage housing 10. This is shown in FIGS. 6 and 6A, where openings 40 are located about halfway along the length of metering tube 20.

As will be obvious to one of ordinary skill in the art, the means for directing a quantity of relatively hot gas from the first stage gas source 101 to a predetermined location within the second stage gas source 102 may take on a variety of shapes and forms in contrast to the configuration shown for metering tube 20 in FIGS. 1 and 3, as long as the output gas from the first stage gas source 101 is introduced into a location or locations within the second stage gas source 102 that allows for the rapid release of gas from the second stage source 102 with the desired temperature profile. For example, the gas directing means may comprise any combination of two or more of the metering tubes described above or any other means that allows the introduction of gas into a desired location within the second stage gas source. For a metering tube or tubes, holes may be positioned at various points along the length of the metering tube, or the tubes may be formed from a porous material in which the porosity is uniform or varies along the length of the metering tube 20 to provide the desired temperature profile for the output gas. The optimum configuration required for the gas directing means to provide the optimal output gas temperature profile for any particular application may be easily determined with a minimum of experimentation.

Preferred inflator 100, which comprises a hybrid inflator as a first stage gas source, operates as follows: initiator 5, typically a pyrotechnic squib, initiates combustion of pyrotechnic material 3*p* within the first stage gas source 101, which contains a pressurized chemically inert gas, thereby increasing the pressure of this gas. In the preferred first stage gas source, the maximum pressure attained by the inert gas on combustion of the pyrotechnic material may be as high as about 30,000 psi. However, if a different pressure is required for a specific application, the first stage gas source may be adapted to provide the required pressure by varying the size of the first stage housing 1, the amount or type of pyrotechnic material, the initial pressure of the stored pressurized gas, or a combination thereof. First stage seal 8 is selected to open at a pressure higher than the initial pressure of the pressurized inert gas, but less than the maximum pressure attained during operation of the first stage gas source.

The opening of the first stage seal allows hot gases to rapidly flow into the second stage gas source 102 via metering tube 20, and into the liquified gas stored in the second stage gas source 102, through the delivery ports in the metering tube, as described above, resulting in the vaporization of the liquified gas. The volume, temperature and pressure of gases supplied to the second stage gas source from the first stage gas source are such that all or substantially all of the liquid gas in the second stage gas source is vaporized. These values are readily determinable by one of ordinary skill in the art without the need for any undue experimentation. As noted above, a variety of alternative gas dispersing techniques, i.e., other than metering tube 20, may be used to mix the gas supplied by the first stage gas source with the liquified gas in the second stage gas source, resulting in the vaporization of the liquified gas and the discharge of the gases from the second stage gas source.

The hot gases dispersed from the tube 20 heat the stored liquified gas, which is typically stored at a pressure of about 900 psi in the second stage gas source 102, vaporizing the liquified gases, and raising the pressure within the second stage gas source to a pressure at which the second stage seal 15 opens, typically, about 3,500 psi, allowing the gases within the second stage source to expand and exit the second stage gas source through the second stage outlet aperture 14, and, typically, through the adaptor 16 into inflatable object 103.

As would be readily understood by one of ordinary skill in the art, the inflation system of the present invention may be readily adapted to inflate inflatable members of varying sizes and shapes. The requirements for inflating a particular inflatable member include the volume of gases required for inflation, the desired temperature of the gases during and after inflation, and the work or energy required to unfold or deploy the inflatable member during inflation. These requirements may be met by selecting the proper sizes for the first and second stage gas source housings and of the first and second stage outlet apertures; the type and amount of propellant burned in the first stage gas source; the types, amounts, and pressures of the gases stored in each stage; and the technique of dispersing and distributing gases as they flow into the second vessel.

The temperature of the inflation gas for an emergency exit chute or inflatable raft for a large passenger aircraft should be in the range of from about −10° C. to 100° C. with the preferred temperature being about 0° C. The final temperature and pressure of the gas within an inflatable member inflated with the inflator of the invention is controlled by the thermodynamics of the inflator apparatus, as well as the size of the inflatable member and the amounts of pressurized and liquified gases stored in the first and second stage gas sources. The factors, phenomena, and conditions which effect changes in temperature, pressure, and heat transfer are set forth below.

When the pyrotechnic material within the first stage gas source is burned, gaseous combustion products and heat are released, heating at least a portion of the pressurized inert gas within the first stage gas source, and increasing the pressure of the gas. When the pressure of the inert gas reaches a preselected value, the first stage seal opens, allowing the mixture of combustion gases and inert gas to be isenthropically, irreversibly, and essentially adiabatically accelerated through the first stage outlet aperture. At the first stage outlet aperture, the pressure of the gas mixture from the first stage gas source is reduced to approximately half, and the gas temperature is reduced approximately ten percent.

As gases exit through the first stage outlet aperture, they accelerate to the local speed of sound in the metering tube in the second stage gas source. As no energy is added to the gas at this point, the temperature and pressure of the gas is reduced. The extended metering tube causes the sonic flow of gas to undergo a series of shocks, which partially restores the pressure and temperatures from the first stage gas source. If all motion of the gas was stopped at this point, the pressure of the gas from the first stage gas source would be essentially restored to the head end chamber conditions. However, although the process of gas passage through the first stage outlet aperture is substantially adiabatic, tests have shown that an energy loss of as much as about five percent may occur due to energy losses in the shocks, such as noise and light, resulting in the temperature only being partially restored.

As the mixture of combustion gases and inert gas passes through and out of the metering tube, the gases released by the first stage gas source are at least partially mixed with the liquefied gas stored in the second stage gas source. Although the great majority of the gas from the first stage gas source mixes, at least partially, with the liquefied gas or its vapors in the second stage gas source before exiting the second stage gas source, some of the gases released by the first stage gas source may exit the second stage gas source into the inflatable member or object without mixing with the stored liquefied gas. However, this incomplete mixing does not affect the final result, although it at least partially accounts for the different temperature profiles that are obtained by using different metering tube configurations.

As the gases released by the first stage gas source mix with the liquefied gas, the liquified gas vaporizes, absorbing an amount of energy equal to the heat of vaporization of the gas at the temperature of the liquid. As other changes in temperature occur, heat energy is absorbed or released according to the heat capacity of the materials heated or cooled. For example, at 20° C., a gram of $CO_2$ absorbs 40 calories as it vaporizes, but, where a gram of vaporize $CO_2$ is heated by 1° C., it absorbs only 0.2 calories.

Although, in theory, the mixture of gases from the first and second stage gas sources expand without doing work, as gases exit from the second stage gas source and pass into the inflatable member, energy is expended as work is performed by the gases to unroll, unfold, and expand the inflatable member against atmospheric pressure. This results in a loss of energy in the gas, which lowers its temperature.

As noted above, where the inflatable member is an aircraft emergency exit ramp or slide or life raft, the temperature of the inflation gases should be no more than about 100° C., and preferably about 0° C. As a result, any water vapor in the inflation gas will condense, reducing the total amount of gas present, and releasing its heat of vaporization, i.e., 585 calories per gram, which heats the remaining gas. Similarly, at the preferred temperature of 0° C., any liquid water in the inflatable member will freeze, releasing an amount of heat equal to the heat of fusion of the water, i.e., 80 calories per gram. The release of heat by the water when it freezes and the absorption of heat when it melts helps to stabilize the system. In a cold environment, any liquid water will moderate the cooling as long as liquid water is present, and, in a warm environment, the presence of ice will moderate heating.

The present invention includes a method of inflating inflatable members of selected size, configuration and material using the inflator of the invention. The method comprises releasing a sufficient quantity of gas from a first stage gas source into a second gas source at a sufficiently high temperature to vaporize substantially all of a liquified gas in the second stage gas source. This causes the liquified gas to vaporize, thereby producing a quantity of gas that is introduced into the inflatable member to inflate the inflatable member.

The first and second stage gas sources of the inflator must be capable of providing an amount of inflation gas sufficient to inflate the inflatable member at the pressure required for the inflated member to function properly. As will be understood by those of ordinary skill in the art, the pressure and volume of the gas produced by the inflator is dependant upon the total volume of the inflated member and the volume of the first and second stage gas sources, as well as the final temperature of the inflation gas. The temperature of the gases in the inflatable member immediately after inflation should be tailored for maximum efficiency. The method of this invention further provides selecting proper pyrotechnic materials, orifices, sizes, burst diaphragms or pop-off valves, and tubes (or other gas dispensers) to accomplish rapid inflatable member inflation by gases of proper volume, temperatures and pressures. The nature of the material of the inflatable member and how it is stored and positioned before inflation affects the amount of energy required to inflate the member.

EXAMPLE

The following non-limiting example is merely illustrative of the preferred embodiment of the present invention, and is not to be construed as limiting the invention, the scope of which is defined by the appended claims.

A test of an inflator constructed according to the invention was performed using a ⅙ scale model. Scaling up the scale model to provide a full scale inflator and inflatable member in which the volumes areas and weights were six times that of the scale model used in the test, but with the same initial pressures, would provide final temperatures and pressures that were the same as those obtained in the test. The first stage gas source used in the test comprised a first pressure vessel containing a compressed inert argon gas and a pyrotechnic material comprising ammonium nitrate, an energizer of cyclotrimethylenetrinitramine, and a binder, and having a rupturable diaphragm as an openable seal. This first vessel was connected to a second stage gas source containing liquid nitrogen, stored at a pressure of 1,100 psi, which, in turn, was connected to an inflatable object, representing a scale model escape ramp or slide having an inflated volume of one hundred sixteen (116) liters. The first stage gas source pressure vessel was 1.5 inches in diameter and 8 inches long, and contained an inert gas stored at a pressure of 3500 psi. Upon ignition of the pyrotechnic material, 16 $in^3$ of gas at a temperature of about 700° C. was released when the pressure within the vessel increased to the point that the diaphragm ruptured. The released hot gases flowed from the first stage gas source into the second stage gas source vessel, which was 2 inches in diameter and 6 inches long.

The introduction of the gas from the first stage gas source into the second stage gas source caused the liquid nitrogen in the second stage gas source to vaporize, thus increasing the pressure, and causing the rupturable diaphragm used as seal for the second stage gas source to rupture. This released a sufficient amount of gas into the one hundred sixteen liter inflatable object to inflate the object to a pressure of 3 psi at a temperature of 0° C. The object was inflated by the gases flowing from the second vessel without the need for any other gas source such as a pump or aspirator.

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments that fall within the true spirit and scope of the present invention.

We claim:

1. An inflator device adapted for producing a sufficient quantity of a gaseous product to substantially inflate an inflatable member operatively associated therewith, comprising:

a first stage gas source;

a second stage gas source in fluid communication at a first location with said first stage gas source and, at a second location, with an inflatable member, wherein said second stage gas source contains liquified gas in an amount sufficient to, when vaporized, inflate the inflatable member; and wherein the first stage gas source is capable of providing a sufficient quantity of gas at a sufficiently high temperature to vaporize substantially all of the liquified gas in the second stage gas source.

2. The inflator device according to claim 1, wherein the first stage gas source comprises means for generating gas from the combustion of a pyrotechnic material.

3. The inflator device according to claim 1, wherein the first stage gas source comprises means for supplying a quantity of compressed gas having a first pressure.

4. The inflator device according to claim 3, wherein the first stage gas source further comprises a source of thermal energy to increase the pressure of the compressed gas.

5. The inflator device according to claim 3, wherein the compressed gas comprises an inert gas.

6. The inflator device according to claim 5, wherein the inert compressed gas comprises at least one of nitrogen, helium, or argon.

7. The inflator device according to claim 1, wherein the first stage gas source further comprises a first stage housing defining a first interior volume, and having an inner surface, the first stage housing containing a pressurized gas at a first pressure in the first interior volume;

a pyrotechnic material within the interior volume of the first stage housing; and a first stage seal adapted to maintain the pressurized gas at the first pressure within the first interior volume, and to open when the gas attains a predetermined second, higher pressure upon combustion of the pyrotechnic material located within the first stage housing to allow the gas to pass from the first stage housing to the second stage gas source.

8. The inflator device according to claim 7, wherein the first pressure is sufficiently high and the pyrotechnic material has a burning time which is sufficiently short, such that, upon combustion, the pyrotechnic material burns substantially completely and without substantial contact of burning material upon the housing inner surface, so at least a portion of the pressurized gas at the first pressure is heated, thereby increasing the gas pressure to at least the second pressure to cause the seal to open and the pressurized gas to exit the interior volume in a time sufficiently short to substantially prevent transfer of heat to the first stage housing.

9. The inflator device according to claim 7, further comprising an ignitor in thermal contact with the pyrotechnic material for initiating combustion of the pyrotechnic material.

10. The inflator device according to claim 1, wherein the second stage gas source comprises a second stage housing defining a second interior volume, an inlet, an outlet, and gas directing means for directing a quantity of gas from the first stage gas source to a predetermined location within the second stage gas source, wherein the inlet is in fluid communication with the first stage gas source and the gas directing means to allow gas to pass from the first stage gas source to the predetermined location within the second stage gas source.

11. The inflator device according to claim 10, wherein the gas directing means is at least one metering tube extending within the interior volume of the second stage housing to direct gas from the first stage gas source into the interior volume of the second stage gas source.

12. The inflator device according to claim 11, wherein the at least one metering tube is adapted to direct the gas from the first stage gas source to a location within the interior volume of the second stage housing proximate to the inlet of the second stage gas source.

13. The inflator device according to claim 11, wherein the at least one metering tube is adapted to direct the gas from the first stage gas source to a location within the interior volume of the second stage housing proximate to the outlet of the second stage gas source.

14. The inflator device according to claim 1, wherein the liquified gas comprises at least one of a freon, a halon, nitrogen, or carbon dioxide.

15. The inflator device according to claim 14, wherein the liquified gas comprises carbon dioxide and up to about 25 mole percent nitrogen.

16. The inflator device according to claim 1, wherein the second stage gas source provides gas having a temperature of from about −10° to 100° C.

17. The inflator device according to claim 16, wherein the second stage gas source provides gas having a temperature of about 0° C.

18. An inflator device adapted for producing a sufficient quantity of a gaseous product to substantially inflate an inflatable member operatively associated therewith, comprising:

a first stage gas source comprising:

a first stage housing defining a first interior volume, and having an inner surface, the first stage housing containing a pressurized gas at a first pressure in the interior volume;

a pyrotechnic material within the interior volume of the first stage housing; and a first stage seal adapted to maintain the pressurized gas at the first pressure within the first interior volume, and to open when the gas attains a predetermined second, higher pressure upon combustion of the pyrotechnic material located within the first stage housing to allow the gas to pass from the first stage housing to the second stage gas source;

a second stage gas source in fluid communication at a first location with said first stage gas source and at a second location with an inflatable member, wherein said second stage gas source contains liquified gas in an amount sufficient to inflate the inflatable member upon vaporization of the liquified gas; and wherein the first stage gas source is capable of providing a sufficient quantity of gas at a sufficiently high temperature to vaporize substantially all of the liquified gas in the second stage gas source.

19. An inflator device adapted for producing a sufficient quantity of a gaseous product to substantially inflate an inflatable member operatively associated therewith, comprising:

a first stage gas source;

a second stage gas source in fluid communication at a first location with said first stage gas source, said second stage gas source comprising a second stage housing defining an interior volume, an inlet, an outlet, and gas directing means for directing a quantity of gas from the first stage gas source to a predetermined location within the second stage gas source, wherein the inlet is in fluid communication with the first gas source and the gas directing means is configured and adapted to allow gas to pass from the first stage gas source to the predetermined location within the second stage gas source; and wherein said second stage gas source is in fluid communication at a second location with an inflatable member, wherein said second stage gas source contains liquified gas in an amount sufficient, upon vaporization thereof, to inflate the inflatable member; and wherein the first stage gas source is capable of providing a sufficient quantity of gas at a sufficiently high temperature to vaporize substantially all of the liquified gas in the second stage gas source.

20. A method for rapidly inflating an inflatable object, the method comprising:

releasing gas from a first stage gas source, the first stage gas source providing a sufficient quantity of gas at a sufficiently high temperature to vaporize substantially all of a liquified gas in a second stage gas source in fluid communication therewith;

introducing the gas released from the first stage gas source into a second stage gas source in fluid communication with an inflatable member, the second stage gas source containing liquified gas in an amount sufficient to inflate the inflatable member upon vaporization of the liquified gas; and distributing the vaporized gas from the second stage gas source within the inflatable member to inflate the inflatable member.

21. The method according to claim 20, further comprising generating gas in the first stage gas source from the combustion of a pyrotechnic material.

22. The method according to claim 20, further comprising obtaining the gas from the first stage gas source from a source of pressurized gas.

23. The method according to claim 22, further comprising adding heat to the pressurized gas, thereby increasing the pressure of the pressurized gas to cause the gas to be released from the first stage gas source.

24. The method according to claim 23, further comprising providing a first stage housing defining a first interior volume, and having an inner surface, the first stage housing containing the pressurized gas at a first pressure in said first interior volume, and a seal adapted to maintain the pressurized gas at the first pressure within the first interior volume, and to open when the gas attains a predetermined second higher pressure; and burning a pyrotechnic material located within the housing to generate heat, thereby increasing the pressure of the pressurized gas to at least the second higher pressure to allow the gas to pass from the housing.

25. The method according to claim 23, further comprising burning the pyrotechnic material in a manner such that the heat from said burning material is substantially entirely thermally transferred to said pressurized gas; wherein said first pressure is sufficiently high and the pyrotechnic material has a burning time which is sufficiently short such that, upon combustion, said pyrotechnic material burns substantially completely and without substantial contact of burning material upon said inner surface such that the pressurized gas at said first pressure is heated, thereby increasing the gas pressure to at least said second pressure to cause said seal to open and said pressurized gas to exit said interior volume in a time sufficiently short to substantially prevent transfer of heat to said housing means.

26. The method according to claim 23, further comprising pressurizing the first stage housing with an inert gas.

27. The method according to claim 26, further comprising selecting the inert gas from the group consisting of nitrogen, helium, and argon.

28. The method according to claim 20, further comprising:

providing a second stage comprising a second stage housing defining a second interior volume, an inlet in fluid communication with the first gas source, an outlet, and at least one metering tube in fluid communication with the inlet and extending within the interior volume of the second stage housing; and introducing the gas from the first stage gas source into the interior volume of the second stage gas source through the at least one metering tube.

29. The method according to claim 28, further comprising adapting the at least one metering tube to release the gas from the first stage gas source at a predetermined location within the interior volume of the second stage housing proximate to the inlet of the second stage.

30. The method according to claim 28, further comprising adapting the at least one metering tube to release the gas from the first stage gas source at a predetermined location within the interior volume of the second stage housing proximate to the outlet of the second stage.

31. The method according to claim 28, further comprising adapting the at least one metering tube to release the gas from the first stage gas source at a predetermined location within the interior volume of the second stage housing intermediate to the inlet and the outlet of the second stage.

32. The method according to claim 20, further comprising introducing a liquified gas, comprising at least one of a freon, a halon, nitrogen, or carbon dioxide, into the interior volume of the second stage.

33. The method according to claim 32, further comprising introducing a liquified gas, comprising carbon dioxide and up to about 25 mole percent nitrogen, into the interior volume of the second stage.

34. The method according to claim 20, further comprising inflating the inflatable member with a gas having a temperature of from about −10° to 100° C.

35. The method according to claim 34, further comprising inflating the inflatable member with a gas having a temperature of about 0° C.

36. A method for rapidly inflating an inflatable object, the method comprising:

providing a first stage gas source comprising a first stage housing defining a first interior volume, and having an inner surface, the first stage housing containing a pressurized gas at a first pressure in said interior volume, and a seal adapted to maintain the pressurized gas at the first pressure within the interior volume, and to open when the gas attains a predetermined second higher pressure;

burning a pyrotechnic material located within the housing to generate heat, thereby increasing the pressure of the pressurized gas to at least the second higher pressure, and providing a sufficient quantity of gas at a sufficiently high temperature to vaporize substantially all of a liquified gas in a second stage gas source in fluid communication therewith;

introducing the gas released from the first stage gas source into a second stage gas source containing liquified gas in an amount sufficient to vaporize said liquified gas, and to thereby produce an amount of gas sufficient to inflate an inflatable member in fluid communication with said second stage gas source; and distributing the vaporized gas from the second stage gas source within the inflatable member to inflate the inflatable member.

* * * * *